US005082468A

United States Patent [19]

Hopkins

[11] Patent Number: 5,082,468

[45] Date of Patent: Jan. 21, 1992

[54] METHOD FOR PIGMENTING FABRICS OF GARMENTS IN TUMBLING MACHINE TO CREATE A NONUNIFORM SURFACE FINISH EFFECT AND COMPOSITION USEFUL IN SAME

[75] Inventor: Gregory J. Hopkins, Rome, Ga.

[73] Assignee: Dexter Chemical Corporation, Bronx, N.Y.

[21] Appl. No.: 580,364

[22] Filed: Sep. 6, 1990

Related U.S. Application Data

[63] Continuation of Ser. No. 243,799, Sep. 13, 1988, abandoned.

[51] Int. Cl.[5] ..... D06P 5/00

[52] U.S. Cl. ..... 8/477; 8/159; 8/483; 8/918; 252/8.6

[58] Field of Search ..... 8/477; 252/8.6

[56] References Cited

U.S. PATENT DOCUMENTS

| | | | |
|---|---|---|---|
| 4,099,913 | 7/1978 | Walter et al. | 8/477 |
| 4,118,526 | 10/1978 | Gregorian et al. | 8/182 |
| 4,193,762 | 3/1980 | Namboodri | 8/477 |
| 4,266,976 | 5/1981 | Gregorian et al. | 8/477 |
| 4,365,968 | 12/1982 | Gregorian et al. | 8/477 |

OTHER PUBLICATIONS

J. Lenoir in Venkataraman's "The Chemistry of Synthetic Dyes", vol. V (Academic Press), 1971, p. 314.

R. W. Moncrieff, "Man-Made Fibres", Sixth Edition (John Wiley), 1975, p. 887.

*Primary Examiner*—A. Lionel Clingman

*Attorney, Agent, or Firm*—Curtis, Morris & Safford

[57] ABSTRACT

A method for pigmenting fabric surfaces to achieve a predetermined nonuniformly colored appearance comprising the steps of a. introducing fabric into a tumbling machine together with an effective amount of a pigment-containing foam composition, which foam composition comprises water, a dispersed pigment, and auxiliaries;

b. tumbling the fabric and foam composition in the tumbling machine for a period of time sufficient to pigment the surface of the fabric thereby creating the desired nonuniformly colored appearance;

c. extracting the excess foam composition from the tumbling machine;

d. removing the pigmented fabric from the tumbling machine and drying it to cure the pigmented surface;

e. washing the pigmented fabric in a detergent composition to remove unbound pigment; and f. drying the pigmented fabric.

6 Claims, No Drawings

METHOD FOR PIGMENTING FABRICS OF GARMENTS IN TUMBLING MACHINE TO CREATE A NONUNIFORM SURFACE FINISH EFFECT AND COMPOSITION USEFUL IN SAME

This application is a continuation under 37 C.F.R. $1.62 of co-pending application Ser. No. 07/243,799, filed Sept. 13, 1988, now abandoned.

BACKGROUND OF THE INVENTION

This invention relates to a method for treating fabrics or garments to create a nonuniform surface finish effect, and a composition useful in same. More particularly, this invention relates to a method of treating fabrics or garments with a certain pigment-containing foam composition, which method results in a nonuniformly colored fabric or garment. The method avoids the use of dyes and results in a fabric or garment having a soft, worn, abraded, or faded appearance, without actual wear or abrasion of those fabrics or garments.

There has arisen in recent years an industry, related to the laundering industry, consisting of methods for imparting a soft, worn, faded nonuniform look to new clothes, in particular, denim jeans. Consumers will pay a significant premium for clothes having a nonuniform surface, with a soft or worn look, and accordingly, a number of methods have been developed by prior workers for treating new garments and fabrics to cause them to have the desired appearance.

A known method for obtaining nonuniformly colored, soft, worn looking fabrics or garments is extract dyeing. In this method, the fabric or garment is dyed to a low depth and then washed or treated to extract unbound dyestuff from the fabric or garment surfaces, thereby resulting in a nonuniform, worn-looking coloration. In this method, however, all fabric surfaces must be treated, which means that when entire garments are treated, they must be dyed both inside and out. Additionally, the dyeing method has the disadvantage of requiring careful temperature control during the dyeing process.

Another method employed for obtaining soft, nonuniformly colored, worn-looking clothes is that wherein large pumice stones, i.e., stones 2 to 4 inches or more in diameter, are used in the washing machine. These large stones circulate with colored garments during the wash cycle and cause the garments to abrade and soften, removing some of the color. There are major problems with this method, however, among them being that the stones break, they collide with the washing cylinder during agitation and cause damage thereto, and, most importantly, they cause damage to the garments themselves. The latter is caused, it is believed, when pumice stones strike one another or strike the washing cylinder and a garment or portion thereof is caught in between. This procedure wears and abrades the garments treated, weakening them, shortening their life-expectancy. This also creates holes in the garments and makes them unsuitable for sale. The pumice stones have also been known to break and form sharp edges and points and these also cause damage to the garments and the washing machine. Still another disadvantage of the pumice stone method is that it is time consuming and labor consuming to remove the stones from the wash cylinder after each cycle and it is inconvenient, if not dangerous, to workers handling the sharp stones. Yet another disadvantage of stone washing methods employing pumice stones is that the stones themselves or fragments thereof actually find their way into the pockets of the garments being washed and they must be removed in a time consuming and labor intensive operation.

In an attempt to cut down the wear and tear on the garments during washing with pumice stones, workers developed another unsatisfactory method of treating fabrics or garments to achieve a soft, worn, nonuniform appearance. This method is a modified pumice stone method, with the added factor that prior to use, the pumice stones are soaked in sodium hypochloride or other bleaching agent. The presoaked pumice stones are then used during the wash cycle with colored garments and result in garments having the desired worn, soft, nonuniform coloration appearance with much less wear and tear on the garment. Unfortunately, this method has the disadvantage that during the washing process, the bleach reacts with the pumice, resulting in a non-water soluble mud-like byproduct. The presence of the mud-like byproduct necessitates the time and cost of repeated rewashings of the treated garments in an attempt to remove the nonsoluble byproduct. The formation of a non-water soluble byproduct also raises environmental concerns related to the difficulties of disposing of such a nonsoluble byproduct.

OBJECT OF THE INVENTION

It is thus a primary object of the invention to provide a method for treating fabrics or garments to create a non-uniformly colored surface finish effect, which finish effect provides the colored garments with a soft, worn, abraded or faded appearance.

It is a further and related object of this invention to provide a method for pigmenting garments, particularly denim garments, to create a soft, worn, non-uniform, abraded or faded surface finish effect, without actual wear or abrasion of the garments.

It is still a further object of this invention to provide a method for creating a non-uniformly colored surface finish for fabrics or garments which is environmentally safe, inexpensive, easy to use and which does not result in objectionable by-products.

It is a further object of this invention to provide a process for pigmenting fabrics or garments to create a non-uniform surface finish effect, which process can be utilized in standard commercial washing equipment and which allows for increased production of treated fabrics or garments.

It is yet another object of this invention to provide a composition useful in pigmenting fabrics or garments, particularly denim fabric or garments, to create a nonuniformly colored surface finish, which composition is used to provide the fabrics or garments with a worn, abraded, or nonuniformly colored appearance, without actual wear or abrasion of the fabrics or garments. The composition may be used to achieve special effects and unique looks on garments by simply adjusting the blow ratio of the foam composition.

SUMMARY OF THE INVENTION

These and other objects of the invention are achieved by employing a novel method for pigmenting fabrics and garments to create a nonuniformly-colored surface finish effect. The method comprises the steps of introducing dyed or undyed garments or fabric containing 20 to 40% moisture content into a tumbling machine, together with an effective amount of a pigment-containing foam composition. The composition comprises water, dispersed pigment and auxiliaries. The fabric or garments and foam composition are tumbled for a period of time sufficient to pigment the surface of the fabric or garments thereby creating the desired, nonuniformly colored surface finish effect. The excess foam composition is extracted and may be retained for subsequent use. The pigmented fabric or garments are then removed from the machine and dried to cure the pigmented surface. The pigmented fabric or garment is then washed to remove unbound pigment and dried.

In one embodiment, the pigment-containing foam composition comprises water, a dispersed pigment, a foaming agent, a stabilizer, a binder and a softener.

Any visible, e.g. not transparent, pigment which may be dispersed in medium may be used for the invention.

A foaming agent which may be used, for example, is a linear ethoxylated alcohol, which helps to induce foaming properties to the mix.

A stabilizer which may be used, is for example, a sodium algenate-based product. The stabilizer permits the maintenance of the desired "semi-stable" foam, i.e. foam which is stable but collapses on contact with absorbent materials. The stabilizer also inhibits pigment migration during drying.

A binder which may be used is, for example, a modified acrylic copolymer which binds the pigment to the substrate.

A softener is used to eliminate any harsh hand which may be present. For example, a mineral oil-based softener, may be used.

In the preferred embodiments, the pigment-containing foam composition is introduced in the amount of from 0.2 to 5.0 times the weight of the fabric or garments to be pigmented; the foam composition has a blow ratio of from 5:1 to 9:1.

The garments or fabrics to be treated are generally made of denim which is "de-sized". In order to de-size the fabric or garments, they are washed with various ingredients, such as a phosphate ester and a chelating agent in order to remove as much nonfibrous material, such as starch, as possible. The de-sizing also serves to soften the garment. Following the de-sizing process, the fabric or garment is partially dried. In the preferred embodiments, the garments or fabrics have a moisture content at this point of from 20 to 40%.

The garments or fabrics are then introduced into a tumbling machine together with an effective amount of the pigment-containing foam composition. The pigment-containing foam composition comprises a disperse pigment or mixture thereof, which is capable of providing the garment or fabrics with the designed finish coloration.

The pigment-containing foam composition may also contain water, a foaming agent, a stabilizer, a binder and a softener.

The fabrics or garments and foam composition are tumbled together for a period of time sufficient to pigment the surface of the fabrics or garments. In the preferred embodiments, the fabrics or garments and foam composition can be tumbled for 5 to 30 minutes, although tumbling time may be as short as 2 minutes and as long as one hour.

Following the tumbling, the excess foam composition is extracted from the tumbling machine; the excess composition may then be retained for later use. The treated garments are then dried for 30 to 90 minutes at 180° F. to 220° F. to cure the pigmented surface. The treated garments or fabrics are then washed, for example in a detergent composition for 10 to 30 minutes, to remove unbound pigment. Finally, the fabric or garments are dried.

EXAMPLE 1

A batch of de-sized denim garments having a moisture content of 30% and weighing 100 pounds is introduced into the receptacle of a commercial tumbling machine. 50–75 pounds of pigment-containing foam composition according to the invention are added to the receptacle as well. The foam composition for tan-colored garments is comprised of:

20.00% of a dispersable yellow pigment
2.40% of a red dispersable pigment
1.20% of a dispersable black pigment
22.00% a modified acrylic copolymer
12.00% a sodium algenate-based foam stabilizer
2.00% a foaming agent such as a linear ethoxylated alcohol The garments and foam composition are tumbled for 20 minutes until the garments are thoroughly coated with foam composition. Excess foam is then extracted and retained for later use.

The garments are then dried for 45 minutes at about 200° F. to cure the pigmented surface. The garments are then washed in a detergent composition for about 20 minutes to remove unbound pigment and are then dried.

EXAMPLE 2

The foam composition for black-colored garments comprises:

30.00% of a dispersable black pigment
30.00% a modified acrylic copolymer binder
12.00% a sodium algenate-based foam stablizier
1.50% a foaming agent such as a linear ethoxylated alcohol

EXAMPLE 3

The foam composition for olive-colored garments comprises:

18.75% a yellow dispersable pigment
3.75% of a black dispersable pigment
22.00% a modified acrylic copolymer binder
7.50% a sodium algenate-based foam stabliizer
1.25% a foaming agent such as a linear ethoxylated alcohol

EXAMPLE 4

The foam composition for burgundy-colored garments comprises:

15.75% of a read dispersable pigment
12.00% of a yellow dispersable pigment
1.50% of a blue dispersable pigment
24.00% a modified acrylic copolymer binder
9.00% a sodium algenate-based foam stabilizer
1.50% a foaming agent such as a linear ethoxylated alcohol The terms and expressions which have been employed are used as terms of description and not of limitation and there is no intention in the use of such terms and expressions of excluding any equivalent of the features shown and described or portions thereof, it being recognized that various modifications are possible within the scope of the invention.

What is claimed is:

1. A method for pigmenting fabric surfaces to achieve a predetermined nonuniformly colored appearance comprising the steps of a. introducing fabric into a tumbling machine together with an effective amount of a pigment-containing foam composition, which foam composition comprises water, a dispersed pigment, and auxiliaries;

b. tumbling the fabric and foam composition in the tumbling machine for a period of time sufficient to pigment the surface of the fabric thereby creating the desired nonuniformly colored appearance;

c. extracting the excess foam composition from the tumbling machine;

d. removing the pigmented fabric from the tumbling machine and drying it to cure the pigmented surface;

e. washing the pigmented fabric in a detergent composition to remove unbound pigment; and f. drying the pigmented fabric.

2. A method for pigmenting the exterior surfaces of garments to achieve a predetermined nonuniformly colored appearance comprising the steps of a. introducing garments into a tumbling machine together with an effective amount of a pigment-containing foam composition, which foam composition comprises water, a dispersed pigment and auxiliaries;

b. tumbling the garments and foam composition in the tumbling machine for a period of time sufficient to pigment the surface of the garments, thereby creating the desired nonuniformly colored appearance;

c. extracting the excess foam composition from the tumbling machine;

d. removing the pigmented garments from the tumbling machine and drying them to cure the pigmented surface;

e. washing the pigmented garments in a detergent composition to remove unbound pigment; and f. drying the pigmented garments.

3. A method for pigmenting fabric surfaces to achieve a predetermined non-uniformly colored appearance comprising the steps of a. introducing fabric into a tumbling machine together with a pigment-containing foam composition in the amount of from 0.2 to 5.0 times the weight of the fabric to be pigmented, which foam composition comprises water, a disperse pigment, a foaming agent, a stabilizer, a binder and a softener, and which foam composition has a blow ratio of from 5:1 to 9:1;

b. tumbling the fabrics and foam composition for a period of from 2 to 30 minutes to pigment the surface of the fabric, thereby creating the desired non-uniformly colored appearance;

c. extracting the excess foam composition from the tumbling machine;

d. removing the pigmented fabric from the tumbling machine and drying it for 30 to 90 minutes at 180° to 220° F. to cure the pigmented surface;

e. washing the pigmented fabric in a detergent composition for 10 to 30 minutes to remove unbound pigment; and f. drying the pigmented fabric.

4. A method for pigmenting the exterior surfaces of garments to achieve a predetermined non-uniformly colored appearance comprising the steps of a. introducing garments into a tumbling machine together with a pigment containing foam composition in the amount of from 0.2 to 5.0 times the weight of the garments to be pigmented, which foam composition comprises water, a dispersed pigment, a foaming agent, a stabilizer, a binder and a softener, and which foam composition has a blow ratio of from 5:1 to 9:1;

b. tumbling the garments and foam composition for a period of from 2 to 30 minutes to pigment the surface of the garments, thereby creating the desired non-uniformly colored appearance;

c. extracting the excess foam composition from the tumbling machine;

d. removing the pigmented garments from the tumbling machine and drying them for 30 to 90 minutes at 180° to 220° F. to cure the pigmented surface;

e. washing the pigmented garments in a detergent composition for 10 to 30 minutes to remove unbound pigment; and f. drying the pigmented garments.

5. A foam composition useful in treating fabric surfaces to achieve a pre-determined non-uniformly colored appearance, which composition comprises water, a dispersed pigment and auxilliaries.

6. A foam composition according to claim 5, wherein the auxilliaries comprise a foaming agent, a stabilizer, a binder and a softener, and which foam composition has a blow ratio of from 5:1 to 9:1.

* * * * *